US005692965A

United States Patent [19]

Nighan, Jr. et al.

[11] Patent Number: 5,692,965

[45] Date of Patent: Dec. 2, 1997

[54] GOLF SWING TRAINING DEVICE WITH LASER

[76] Inventors: William L. Nighan, Jr., 311 Waverly St., #3, Menlo Park; Steven Arkley, 1681 Austin Ave., Los Altos Hills, both of Calif. 94025

[21] Appl. No.: 570,892

[22] Filed: Dec. 13, 1995

[51] Int. Cl.[6] ..... A63B 69/36

[52] U.S. Cl. ..... 473/220; 362/259; 362/102; 362/234; 362/250

[58] Field of Search ..... 473/220; 362/102, 362/234, 250, 259

[56] References Cited

U.S. PATENT DOCUMENTS 3,070,373 12/1962 Mathews et al. ..... 473/220 X
3,863,933 2/1975 Tredway ..... 473/220
4,108,441 8/1978 Tredway ..... 473/220
5,465,972 11/1995 Cornett ..... 473/220

FOREIGN PATENT DOCUMENTS 9218388 12/1992 Australia ..... 473/220

*Primary Examiner*—George J. Marlo
*Attorney, Agent, or Firm*—Wilson Sonsini Goodrich & Rosati

[57] ABSTRACT

A golf swing training device includes a golf club including a head coupled to a shaft. At least one laser device detachably coupled to the shaft of the golf club and produces at least one laser beam. A power source is coupled to the laser device. An attachment mechanism detachably secures the laser device to the golf club shaft in a manner such that the laser beam provides a feedback signal to the golfer that is indicative of a position and a motion of the head during the top of a backswing of the golf club by the golfer.

7 Claims, 4 Drawing Sheets

GOLF SWING TRAINING DEVICE WITH LASER

FIELD OF THE INVENTION

This invention relates generally to golf, and more particularly to devices used to improve or monitor the golf swing. Lasers or light sources can be implemented in this invention.

BACKGROUND OF THE INVENTION

Various devices have been invented or proposed over recent years for the purpose of improving or otherwise monitoring the golf swing (swing) of a player of golf (golfer). These devices can be divided into two basic categories; the first category relates to putting aids, and the second to aids for the rest of golf swings. For the purposes of this patent, a golf swing will denote any type of golf swing, including putting swings, whereas the term putting or put will refer only to golf swings that utilize a putter and keep the head of the putting club relatively close to the ball before striking it.

While many of the example training devices utilize simple mechanical components or designs to help a player monitor his swing (example: the "Medicus" swing trainer club, commonly available in many golf accessory ships), recently laser devices have been used in this application. In particular, laser devices have been incorporated into putters, or attached to putters, with the goal of assisting the golfer with his putting by projecting a laser beam in a way that indicates some feature of the putting stroke. In the prior art, lasers have not been attached to other golf clubs, such as driving clubs. This is primarily because the speed of the head of the driver club in a drive shot is significantly faster than that of the head of a putter club in a putting shot, and because the head of a driver is taken a large distance away from the ball during parts of the swing, whereas this is not the case in putting. It is not obvious from the prior art that a visible laser could be used to provide visual feedback to the golfer as his swing in non-putting shots is executed. It is also not obvious that a laser or light aiming device could be utilized in a manner that provides visual feedback to the golfer about the swing, but does not necessarily project a laser beam in the direction of club head travel or (desired) ball travel.

Two important advances have allowed the inclusion of visible laser devices in golf-related (and other) products that are affordable to the consumer. One is the development of semiconductor diode lasers (diode lasers) at visible wavelengths, such as 635 nm to 670 nm. These diode lasers are solid-state, robust, efficient, and are much lighter and more compact than their 633 nm helium-neon gas laser predecessors. Diode lasers can provide useful amounts of visible red light with simple battery power, which is simply not possible with HeNe lasers. They may therefore be incorporated into a variety of applications that can not tolerate the size, weight, or efficiency of a HeNe laser. However, diode lasers can provide enough power to create a bright spot that is visible to the eye, but relatively safe. A typical power is 1 to 4 mW. The second advance has been the general decline in cost of the diode lasers. It is possible to purchase a laser that provides 1 to 5 mW of red light at 635 to 670 nm for less than $100. A vendor of such lasers is the former Applied Laser Systems, or ALS, formerly of Oregon, now owned by Coherent Auburn Group, in Auburn, Calif. The combination of compactness and cost-effectiveness of diode lasers has enabled a number of applications. A familiar application is as a pen-sized laser pointer; the company "Sharper Image" features a selection of these devices, these pointers ranging from ~$50 to ~$400 in price, and available via a commonly available mail-order catalog dated approximately Oct. 1995. The optical power delivered from these devices is high enough to project a bright, visible spot at useful distances, but low enough to be relatively safe to the eye, and skin.

One popular application for HeNe lasers and visible diode lasers is the barcode scanner, as found at checkout counters of most large supermarkets. In this case, the red laser beam is scanned over a barcode label on a product, and the light that is scattered from the label is detected and converted into a signal. This signal is matched to a price in a look-up table in order to provide a price for a particular good. Until recently, HeNe lasers were typically used in these scanning systems, since the laser did not need to be small or lightweight. However, the compact hand-held versions of these supermarket scanners almost universally utilize diode lasers. The compactness of the diode laser allows the hand-held scanner to be lightweight and compact.

Another application for visible diode lasers is as aiming devices for guns. Since a laser beam can be projected over great distances in a perfectly straight line, it can be used to parallel the trajectory of a bullet from a gun. If the visible diode laser is appropriately aligned to the gun, and if appropriate optics are used, the diode laser will project a beam onto a target, indicating with great precision where a bullet would strike if the gun user were to pull the trigger. The laser beam propagates in the direction of the bullet, or in very nearly the same direction as the direction that the gun user would like the bullet to travel when he pulls the trigger. Such aiming devices are also available from ALS.

Another application for an aiming device that incorporates a visible diode laser is for pool or billiards cue sticks. The laser is mounted on the stick, with its visible red beam projecting nearly parallel to the major axis of the cue stick and in the direction that the cue stick is launched when it strikes the cue ball. The beam is projected onto the cue ball, and is projected in a direction that is roughly equivalent to the direction that the player wishes the cue ball to travel after he strikes it. Such a device is available from the Sharper Image, which offers products for sale via mail-order catalogs.

Recently, visible diode lasers have been incorporated into devices for the golfer and golf training. Most of these devices have been associated with putting. Because of the availability and relatively low cost of low power visible diode lasers in recent years, it has become relatively obvious that a laser pointing device could be attached to a golf putter for a reasonable expense. The realization that laser must be compact (like a diode laser) if it were to be attached to a hand-held device (i.e. the putter) stems both from the prior art of hand-held bar-code scanners and the prior art of aiming devices for guns. Because of these examples of prior art, and others, it was relatively straightforward for inventors to extend the concept of laser aiming to the golf putter. The visible diode laser made the attachments or incorporations lightweight and reasonably priced. The relatively low speeds and limited travel range of the putter head during the putting motion made the extension of gun aiming technology to putting relatively obvious. For these reasons, a variety of laser putting aids became available to golfers in a relatively short time period.

There is a similarity between laser gun sight devices and these recent putting aids. Again, these devices have typically been arranged in a way that projects the laser beam in the direction that the golfer wishes the golf ball to travel after he strikes it. The "Eye of the Zebra" putter, available from Ram Golf, USA is probably the best known laser-putting device; the laser is incorporated into the head of the putter, and is positioned in order to project the visible laser aiming beam in the direction that the putter head travels and in the general direction that the golfer would like the golf ball to travel after he strikes it with the slow moving putter. The "Eye of the Zebra" putter is available in many golf pro shops. The small diode laser that is incorporated into the putter head can be turned on with a switch and batteries in the handle of the putter. The red diode laser beam propagates from the face of the head of the putter. As stated, this beam propagates in the general direction that the golfer wishes the ball to travel after he strikes it; the golfer is to hold the club in a way that the laser beam is propagating in the direction that he or she would like the ball to travel when it leaves the club face. Additionally, the beam from this "Zebra putter" is to be projected onto the ball itself; this gives an indication of the position of the club face during the stroke of the putting motion. This device has some similarities to the aiming devices used with guns. However, this device or its concept cannot be used for general golf swings, such as the drive. If a driver were constructed in the manner of the "Zebra putter", with a laser in the club face, the beam from the club face would be invisible to the golfer when the club was overhead, at the top of the swing. The reason is that when the club is overhead, the club head face and laser would be pointing upward, into the sky. During this overhead part of the golf swing, this type of device therefore could not provide any visual cue to the golfer that would be useful. The beam would eventually become visible to the golfer, as the club approached the ball. A red spot would be visible on the ball. However, it would appear so rapidly and so briefly that it would provide little information about the main components of the golf swing. For this reason, it is not obvious from the prior art exactly how a laser aiming device might be attached to a club other than the putter but still provide useful visual (or other) feedback about the golf swing. If the attachment or incorporation of the laser into the non-putting club were executed in a way analogous to prior art of lasers in/on putters, the projected laser aiming beam would be invisible to the golfer for most of the swing, and when the beam became visible to the golfer (with the club head just about to strike the ball), it would only be visible for such a short time that the amount of visual feedback would be minimal. There is therefore a need for an invention that could incorporate a device that provided visual or other feedback to the golfer over a much greater range of his swing, especially for swings other than putting swings. Other putting aids are very similar to the "Eye of the Zebra" putter, and so are considered in the same category. Examples are "Laser Putt", from J&T Electric, Texas, USA, "LyteTrainer Universal Putting System", from Lyte Electronics, USA, and "PUTTron", from Victron Products, USA. These and other laser-based golf training aids were recently reviewed in "Golf Tips", July 1995. These devices are restricted to putting, and only provide visual cues to the golfer when the club face is near the ball, as in putting. However, golf swings other than the putt have a significant number of components with the club face far from the ball. There is a need for a device that provides feedback to the golfer for these other parts of the golf swing. These other parts of the golf swing include the takeaway, the backswing, the top of the swing, and the down swing. The concept of the "Eye of the Zebra" putter cannot be extended to the other golf clubs and other golf swings to provide this type of feedback. Feedback or indications of the nature of other parts of the general golf swing can help a player monitor and even modify his or her technique. There is a need for such devices. Further, there is a need for a device that can be used by golfers for self-monitoring of the golf swing that is portable, can be attached and detached to or from any of the golfers' clubs, and is reasonably priced and easy to use.

One other laser device that has been recently introduced for golfers is the "StabiLaser", from DynaLaser Technology of Irvine, Calif., which is basically a hat or visor with a visible laser diode in the brim of the hat. This device differs from the putting devices already described in that it does not attach to the club itself. The device projects a red beam on the ground in order to give the golfer visual feedback about the motion of his or her head during the golf swing. This device can be used for any golf swing, but it does not provide visual feedback about the position or motion of the golf club during its swing. There is a need for a device that would provide such feedback, since the position or motion of the golf club during its swing has a tremendous effect upon the accuracy and distance that a golfer can achieve with his or her swing.

Finally, a device has recently become available that incorporates a laser device in the grip end of the club, with the laser beam pointing in line with the axis of the shaft of the club. The device is marketed under the name "TrailBlazer", and is available via mail order from the Sharper Image, a well-known mail order company. This device is embodied by a laser club (which is an iron, not a putter), the grip of said club containing a visible laser diode, as in FIG. 1(*b*). When the golfer stands at the address position, with the head of the club near the ball, the beam projects upwards, towards the chest, and is not readily visible to the golfer. As the golfer begins the takeaway of the swing, the beam is still not visible. The beam is primarily visible during the part of the backswing where the club is nominally vertical to the ground, with the club head in the air at its highest position, as in FIG. 1(*b*). It is also visible during the down swing, at an analogous point. This device is somewhat useful in that it does provide some visible feedback to the golfer regarding the position and motion of the club during the swing, and especially swings other than putting swings. However, since the laser beam projects from the grip, it does not provide accurate visual feedback indicative of the position of the head of the golf club, but rather the grip. It would be desirable to provide an invention that would provide information about the motion and position of the head of the club. Also, this device does not allow the golfer to use his or her favorite clubs, since the invention is available only as an integrated unit, laser and special club. Because of the location of the laser in the grip end of the club, it would not be straightforward to design a version of the "TrailBlazer" device that would allow attachment/detachment of the laser device to and from a golfer's favorite club. Additionally, this device does not provide visual feedback during a particularly important part of the swing, which is the transition point between the end of the backswing and the beginning of the downswing. At this important part of the golf swing, the laser beam from the end of the "TrailBlazer" projects off into the distance, nearly parallel to the ground, and therefore is not visible to the golfer in his field of view, which is centered around the ball at his or her feet. For similar reasons, the beam is not visible to golfer at the takeaway, or early parts of the backswing. The projected beam from the "TrailBlazer" is therefore not visible to the golfer at critical transitional parts of the golf swing, but is rather only visible during the middle of the backswing and middle of the downswing. A device is needed that provides useful feedback to the golfer at the important transition between backswing and downswing. An invention that would provide feedback to the golfer about the position and motion of the club, particularly the club head, at this part of the swing would be highly useful. An invention that would provide visual feedback during the takeaway would also be highly useful. In particular, an invention that would provide information about the position of the head of the club during various parts of the golf swing would be highly useful. Further, there is a need for an invention that can be attached and disconnected to the golfer's own favorite clubs, said invention providing feedback to the golfer about the motion and position of the golf club, particularly the head of the club, during the golf swing.

A general difficulty in learning and controlling the golf swing is the fact that a large range of the important motion of the head of the golf club is not readily visible to the golfer as he or she swings the club. For example, approximately ⅔ of the backswing and ⅔ of the downswing is out of the field of view of the golfer swinging the club. The position and motion of the head of the club at the important transition from backswing to downswing is not visible to the golfer. In the last ⅓ of the downswing, by the time the club head comes into the golfer's field of view, it is effectively too late for the golfer to affect any changes to the trajectory of the head of the club before it strikes the golf ball. In general, a golfer must seek the help of a coach to observe these important parts of the swing, as they are typically difficult for a golfer to self-monitor. An invention that would provide feedback to the golfer about these important parts of the swing would be highly useful. Further, it would be highly useful if a device that provided feedback to the golfer about the position and motion of the head of the golf club during the important parts of the swing were available. In particular, no device exists in the prior art that provides visual feedback to the golfer regarding the position and motion of the head of the club during the important parts of the swing that include the end of the backswing, the beginning of the downswing, and the transition between the backswing and downswing.

SUMMARY OF THE INVENTION

It is an object of the invention to provide feedback to the golfer during the golf swing in order to help the golfer monitor or modify the important parts of his or her swing.

It is an object of the invention to utilize a light source attached to the golf club in order to provide feedback to the golfer during the golf swing in order to help the golfer monitor or modify the important parts of his or her golf swing.

It is an object of the invention to utilize a light source attached to the golf club in order to provide feedback to the golfer during the golf swing in order to help the golfer monitor or modify the important parts of his or her golf swing, said light source attachable and detachable to and from the club.

It is an object of the invention to utilize a visible laser source attached to the golf club in order to provide feedback to the golfer during the golf swing in order to help the golfer monitor or modify the important parts of his or her golf swing, said visible laser source providing feedback indicative of the position and motion of the head of the golf club.

It is an object of the invention to utilize a visible laser source attached to the golf club in order to provide feedback to the golfer during the golf swing in order to help the golfer monitor or modify the important parts of his or her golf swing, said visible laser source providing feedback indicative of the position and motion of the head of the golf club, said laser attachable and detachable to and from the club.

It is an object of the invention to utilize a visible laser source attached to the golf club in order to provide visual feedback to the golfer during the golf swing in order to help the golfer monitor or modify his or her golf swing, with the laser source projecting at least one beam from the club, near its head, the beam in a direction other than the direction that the club face follows and/or other than the desired travel direction of the golf ball after striking it, at least one of said beams projected from the club in a direction signficantly different from parallel to the shaft of said club, at least one of said beams providing visual feedback to the golfer regarding the position and motion of the head of the club.

It is an object of the invention to utilize a visible laser source attached to the golf club in order to provide visual feedback to the golfer during the golf swing in order to help the golfer monitor or modify his or her golf swing by monitoring the position and motion of the head of the club, with said laser source projecting a visible spot onto the ground or a screen when the club is at various parts of the golf swing.

It is an object of the invention to utilize a laser light source attached to the golf club in order to provide visual feedback in the form of a spot visible to the golfer during the golf swing, the visible spot providing information regarding the motion and position of the head of the club in order to help the golfer monitor or modify his or her golf swing, with said laser light source projecting said visible spot onto the ground or a screen during the backswing, the top of the swing, and/or the downswing of the golf swing, said visual feedback being observable during a significant fraction of the golf swing.

It is an object of the invention to utilize a laser light source attached to the golf club in order to provide visual feedback in the form of a spot visible to the golfer during the golf swing, the visible spot providing information regarding the motion and position of the head of the club in order to help the golfer monitor or modify his or her golf swing, with said laser light source projecting said visible spot onto the ground or a screen during the backswing, the top of the swing, and/or the downswing of the golf swing, said visual feedback being observable during a significant fraction of the golf swing, with said laser source attachable and detachable to and from the golf club.

These and other objects of the invention are achieved in a lightweight, compact device that includes a simple clamp for attachment and detachment to and from a golf club. At least one visible diode laser is incorporated in the device. A power source, such as batteries, is included, and may be attached to the club. Electrical current flows from the power source to the diode laser when a visible beam is desired. The visible beam is projected in a direction that provides visual feedback to the golfer about the position and motion of the head of the club during a significant fraction of the complete golf swing, but in a direction that is not necessarily the same or similar to the desired direction of club face or ball travel. The visible beam provides visual feedback to the golfer about the position and motion of the head of the club at the end of the backswing, the beginning of the downswing, and the transition between these two important parts of the golf swing. The visible beam or beams can be nominally perpendicular to the desired path of the club face toward the ball, and can be nominally perpendicular to the desired path of the ball after the club face strikes it.

In another embodiment, an additional beam projects downward from the head of the club, towards the ground, in order to project a visible beam towards the ground at the address position and the beginning of the takeaway and backswing. In this embodiment, not only is visual feedback provided at the end of the backswing and beginning of the downswing, but also at the address position, the takeaway, and the beginning of the backswing.

With this invention, a device is made available to the golfer to self-monitor the important parts of the golf swing. This device is easily attached or detached to or from the golf club, making it possible for the golfer to use the invention with his or her favorite golf clubs.

DETAILED DESCRIPTION OF THE DRAWINGS

FIG. 1(*b*) depicts a schematic diagram of the "TrailBlazer" golf club.

FIG. 2(*b*) is a schematic diagram of a golfer with a golf club at a beginning of a back swing and indicates the range of motion of a putt.

FIG. 2(*c*) is a schematic diagram of a golfer with a golf club during a back swing.

FIG. 2(*d*) is a schematic diagram of a golfer with a golf club during a down swing.

FIG. 3(*b*) is a schematic diagram of a golfer with a golf club at a beginning of a back swing and indicates the range of motion of a putt with a laser device attached to the golf club.

FIG. 3(*c*) is a schematic diagram of a golfer with a golf club during a back swing with a laser device attached to the golf club.

FIG. 3(*d*) is a schematic diagram of a golfer with a golf club during a down swing with a laser device attached to the golf club.

Figure 4A:
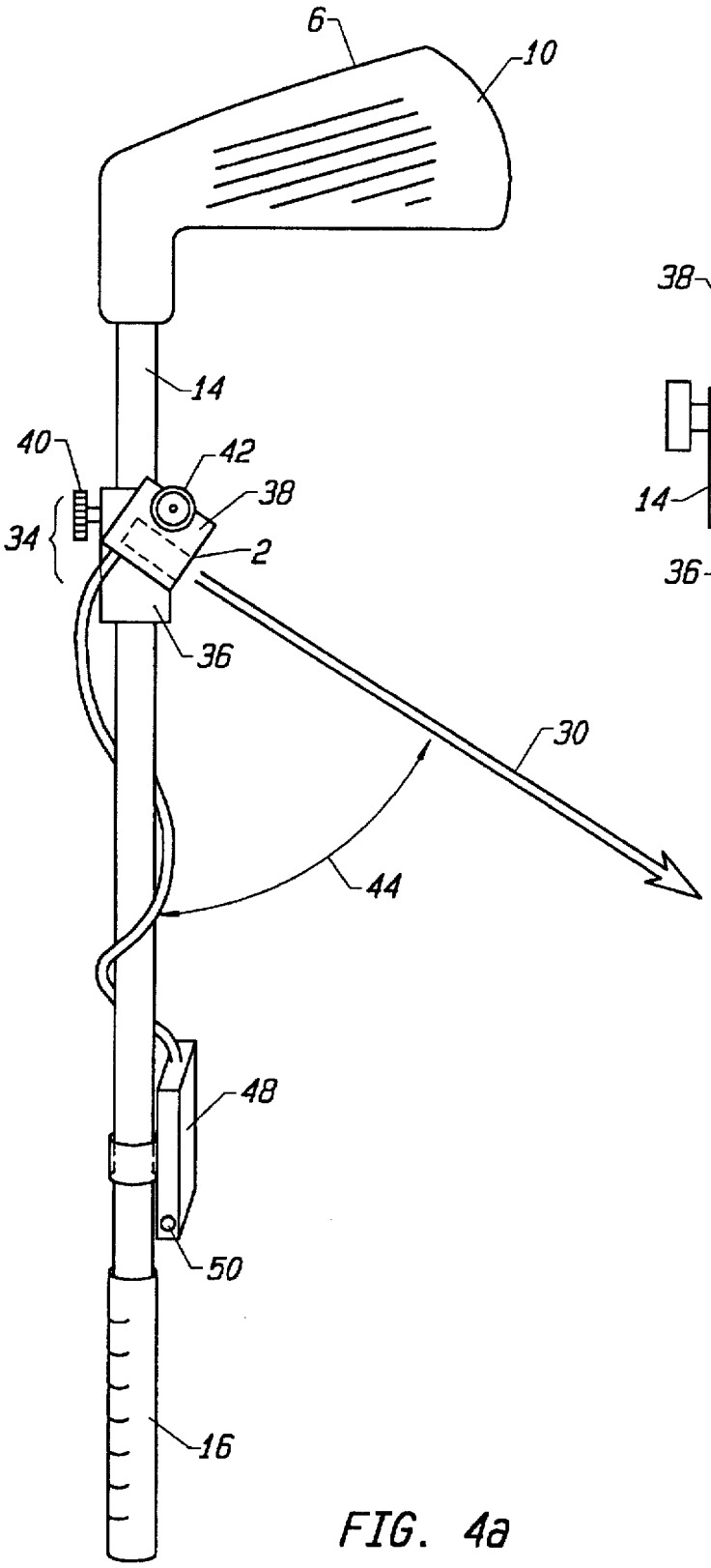
Figure 4B:
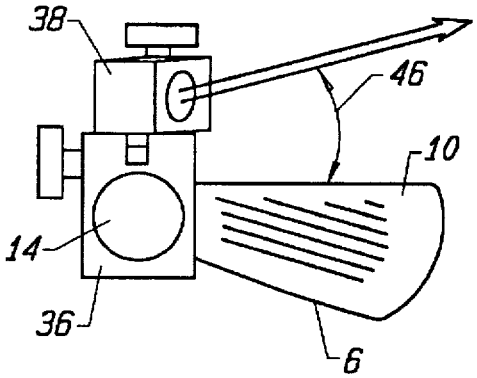

FIGS. 4(*a*) and 4(*b*) show a preferred embodiment of the invention that is attached to the golf club.

DETAILED DESCRIPTION OF THE PREFERRED EMBODIMENTS

For the purposes of the following description of the invention, the following definitions are used:

- a "golf swing" is the general class of motions of the golf club, as executed by the golfer, as he or she undertakes striking a golf ball (or ball) with a golf club (or club).
- a "putt" is a specialized form of a golf swing, where a putter is used, and where the head of the putter does not travel very far from the ball (i.e. typically not >2 feet) before the putt is executed.
- the "address position" is considered to be the beginning of the "golf swing", where in this position the club face is close to the ball, the club face is relatively still with repect to the ball, and the club face is oriented in a way similar to the way the golfer desires it to be when he/she strikes the golf ball.
- the "take away" is considered to come after the "address position" at the beginning of the golf swing, and constitutes the first part of the golf swing where the club head is moving away from the ball. The "take away" is the early part of the "back swing".
- the "back swing" constitutes that part of the golf swing where the club head is moving away from the ball.
- the "top of the swing" is the part of the golf swing that is in between the "back swing" and the "down swing". The club is nearly motionless for an instant at the "top of the swing".
- the "down swing" consitutes the part of the golf swing where the club head is moving towards the ball. The end of the "down swing" is when the club face strikes the ball.

Figure 1A:
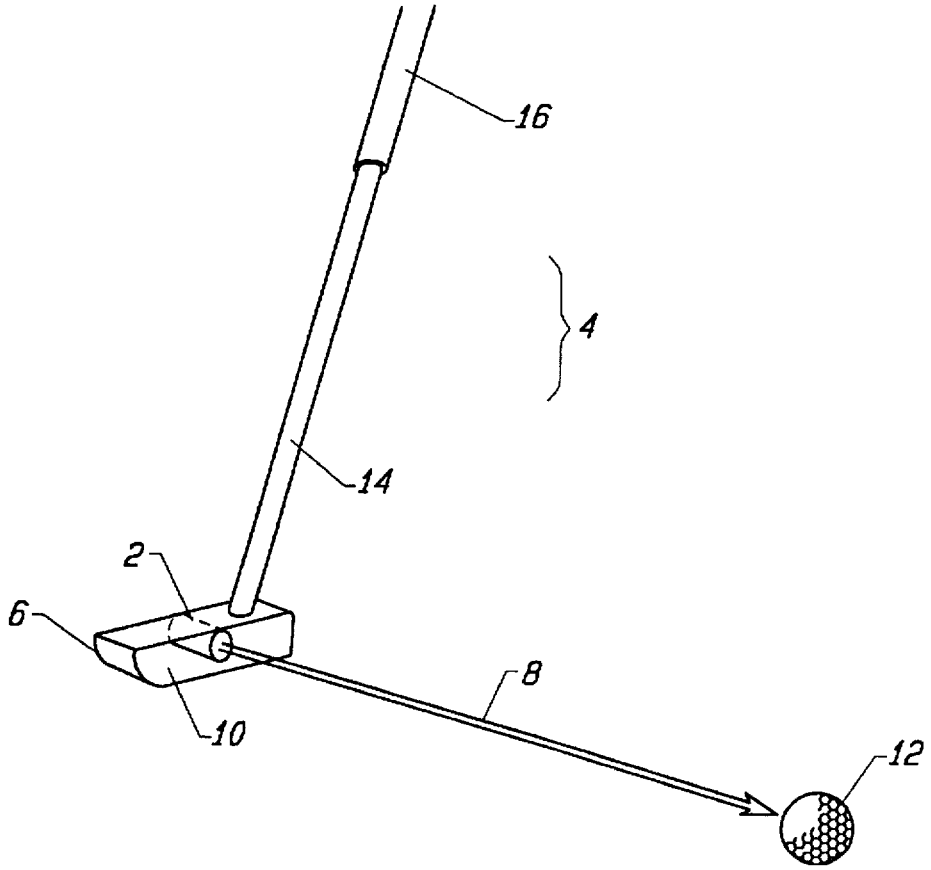
FIG. 1a (PRIOR ART)
FIG. 1(*a*) is a schematic diagram of a prior art "laser putter", and indicates the typical parts of a golf club.
Figure 1B:
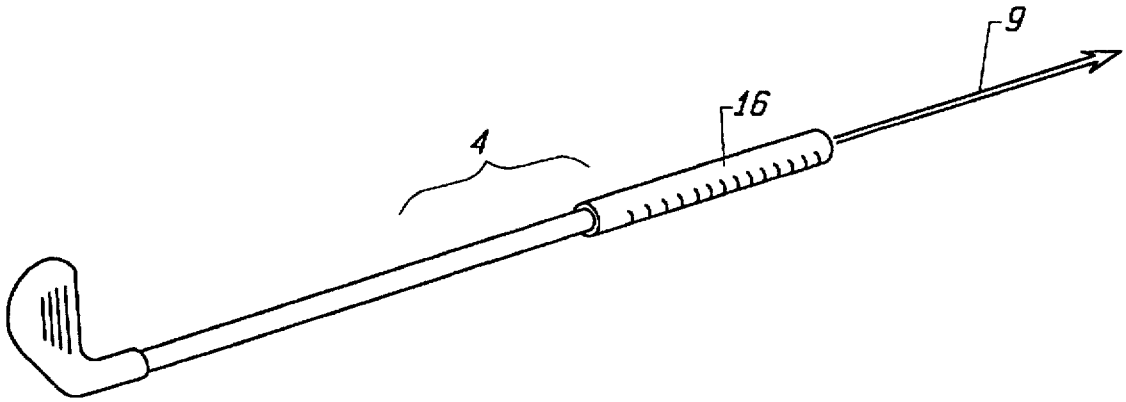
FIG. 1b (PRIOR ART)
Figure 2A:
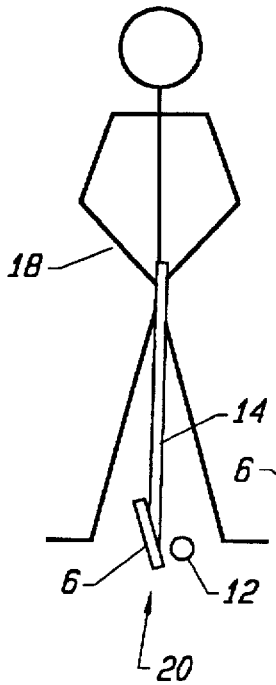
FIG. 2(*a*) is a schematic diagram of a golfer with a golf club at the beginning of a golf swing.
Figure 2B:
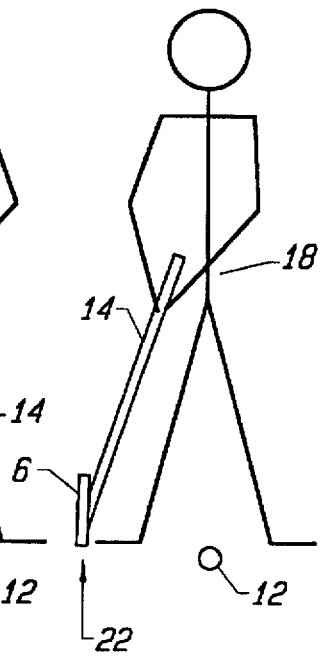
Figure 2C:
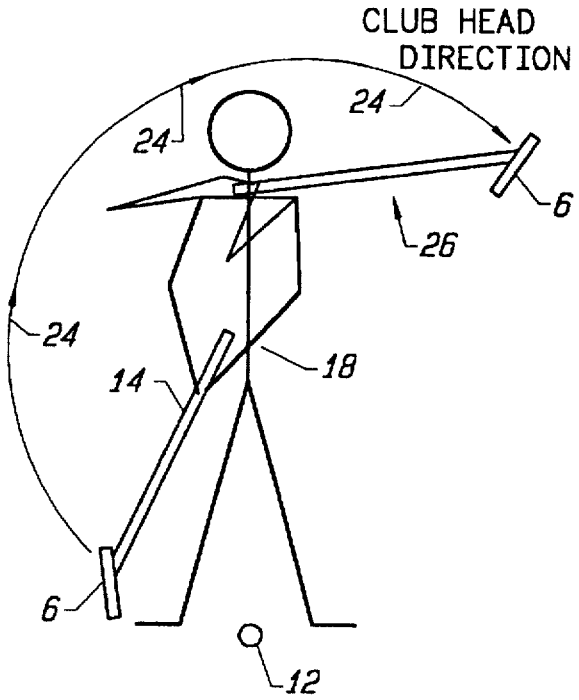
Figure 2D:
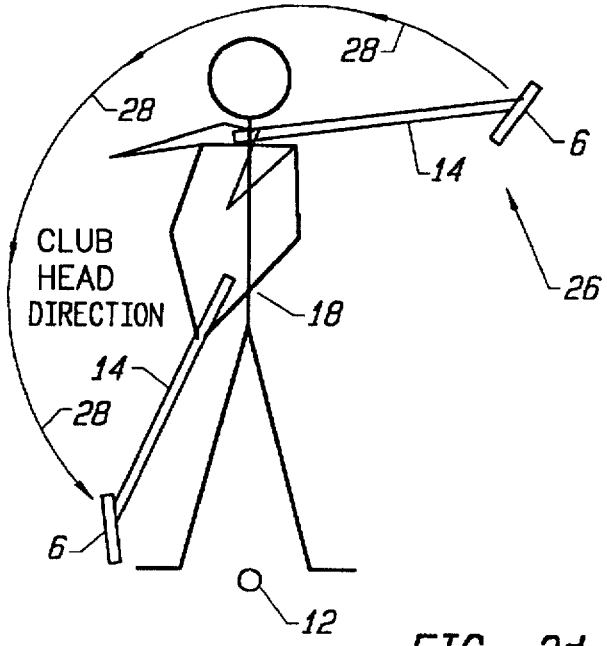
Figure 3A:
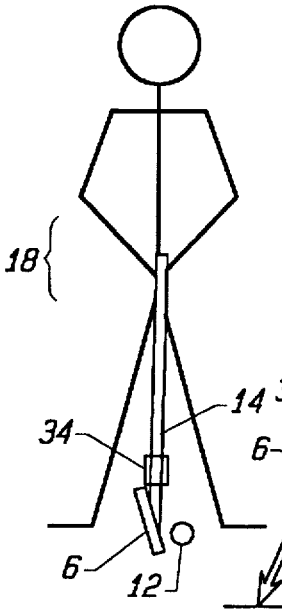
FIG. 3(*a*) is a schematic diagram of a golfer with a golf club at the beginning of a golf swing with a laser device attached to the golf club.
Figure 3B:
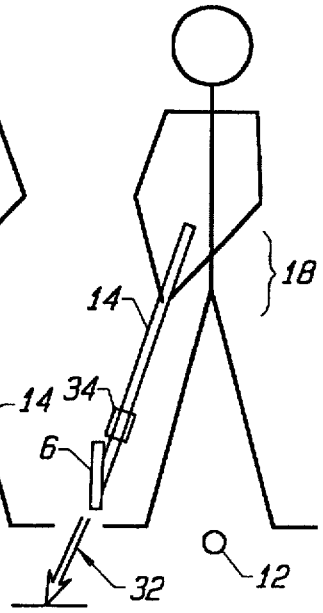
Figure 3C:
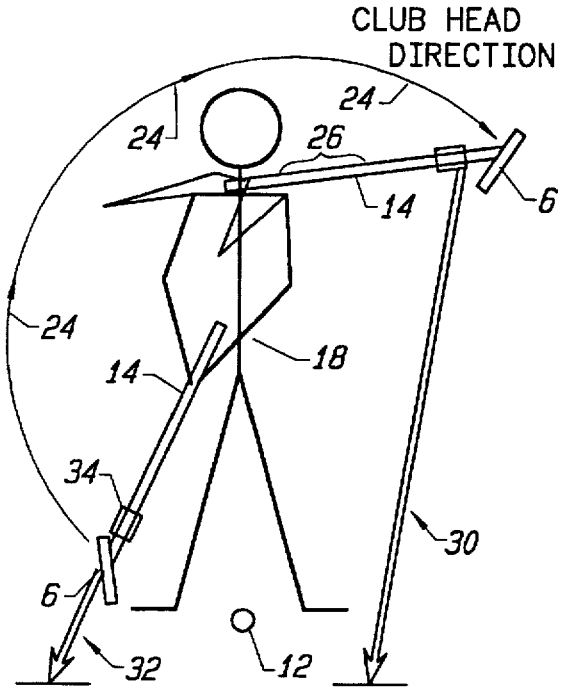
Figure 3D:
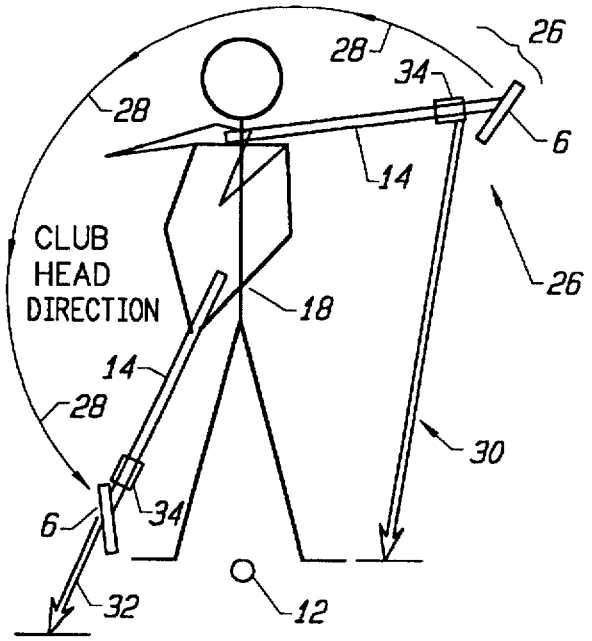

In FIG. 1(*a*), a prior art "laser putter" is depicted. This figure also indicates relevant parts of a general golf club 4. A visible diode laser 2 is positioned in or near club head 6, generating visible laser beam 8 in a direction roughly perpendicular and away from club face 10. This visible beam 8 propagates in a direction similar to that desired for the golf ball 12 after the club face 10 strikes the ball. Visible beam 8 can be projected onto ball 12. Not shown is a power source, such as a battery, for the diode laser. The beam is red in the prior art, with a wavelength in the vicinity of 635 nm to 670 nm. Club shaft 14 is depicted, as is grip 16. A conventional prior art golf club would took similar to 4 in FIG. 1, except that visible laser diode 2 would not be included. Shown in FIG. 1(*b*) is the prior art "TrailBlazer" laser golf club. In this case visible beam 9 emanates from the end of the grip of the golf club. When the club head is at its highest point in the air, the beam projects at the ground. It does not provide feedback to the golfer at the end of the backswing In FIG. 2(*a*), 2(*b*), 2(*c*), 2(*d*), a golfer 18 is shown, with the club position at various parts of the golf swing. Position 20 indicates the address position. Position 22 is approximately the range of positions for putting, which therefore includes only a short backswing after the take away. Positions 24 indicates the back swing. Position 26 indicates the top of the swing. Position 28 indicates the downswing.

In FIG. 3, golfer 18 is shown, with the club position at various parts of the golf swing as in FIG. 2, but with a laser beam 30 projected from the invention 34 during these different elements of the swing. The beam 30 is projected onto the ground or a screen that is visible to the golfer as he/she golfs or practices the golf swing. Beam 30 is used by the golfer to monitor his/her golf swing. Beam 30 is visible for a significant fraction of the golf swing. There may also be an optional second beam 32. In the case of beam 30 and second beam 32, a laser beam projection is seen by the golfer over a large fraction of the golf swing. In a preferred embodiment, the second beam 32 is generated by a second laser. This optional second beam 32 can also be generated from the first beam 30 with a beamsplitting mirror or mirrors, not shown.

In FIG. 4(*a*) is a diagram of a preferred embodiment of the invention 34 that is attached to the golf club. The device is clamped to golf club 4, typically on shaft 14. It is removable in a preferred embodiment, allowing attachment to any golf club. The device is configured to allow the device to be clamped on club 4 at any rotational position with respect to the plane defined by the club face and the shaft axis. This is accomplished by means of clamps 36 and 38. In a preferred embodiment, the clamping mechanism utilizes two clamps, and two tightenable knobs 40 and 42. The laser 2 is contained within clamp 38. In a preferred embodiment, the laser is a 2.5 mW, 635 nm laser, available from ALS. It is battery-powered, and generates beam 30. With respect to the plane defined by shaft 14 and club head 6, the directional component of laser beam 30 out of the plane therefore is chosen anywhere between zero and 360 degrees. This angle is angle number 44, and in a preferred embodiment, is approximately 60 to 70 degrees. An additional clamp 38 and knob 42 are used to adjust the directional component of laser beam 30 within the plane defined by the club head 6 and the club shaft 14. This angle 46 can also be chosen between zero and 360 degrees, and is depicted in FIG. 4(*b*). With these two directional controls, the laser beam 30 can be adjusted to project upon the ground or a screen at any point during the golf swing. The invention extends to any attachment technique that accomplishes the result of aiming the laser from the club to the ground or a screen in order to provide a visual feedback beam to the golfer. In a preferred embodiment, the device 34 is clamped to shaft 14 near club head 6. It is preferred that the laser device is positioned in a way that provides an indication of the position and motion of the head of the golf club. For example, at the top of the swing, the beam 30 can be adjusted to project on the gound, near the golf ball. This projection of beam 30 is therefore visible to the golfer, who is looking at golf ball 12 during the swing. The projection of beam 30 indicates the position and motion of the head of the golf club. In this case, the projection of beam 30 is also visible to the golfer during the last portion of the backswing, and the first portion of the downswing. The golfer observes the projection of beam 30 come into his peripheral vision during the end of the backswing, then slow and stop near ball 12 at the top of the swing, and then move away from ball 12 at the beginning of the down swing, finally disappearing from midway through the downswing. The position and relative motion (direction and speed) of the projection of beam 30 on the ground or on a screen provides visual feedback to the golfer during the swing, for a large fraction of the swing. This type of feedback was not available in the prior art. It assists the golfer in the determination of the position and motion of the head of the golf club, particularly when the head of the club is near the top of the swing. An optional second beam can also be generated, not shown in FIG. 4, either by incorporation of a second laser or by splitting off a portion of beam 30 with a beam splitting device. The optional beam can give the golfer feedback about the take away of the golf swing, and the beginning of the backswing.

As shown in FIG. 4, the visible laser diode can be activated by a battery-powered supply 48, also attached to the golf club in a preferred embodiment. This battery power is considered to be well-known by one skilled in the art. In a preferred embodiment, the batteries can be fastened to the club near the grip of the golf club. In a preferred embodiment, the overall weight of the invention is light, at least relative to the weight of the golf club. It is for this reason that a lightweight battery supply is preferred. Typical AA or AAA batteries can be used to provide a few hours of operation. An on/off switch 50 can also be included. It can be pressure-sensitive, as is known in the art of laser aiming devices for handguns. If desired, the battery power supply can be mounted off of the club as well, such as on the wrist or belt, which serves to take weight away from the head of the club. Typical "wall-plug" AC electrical power can also be used if the right DC power Supply is selected.

An object of the invention is to project a beam of light from the club to the ground or a screen, in order that the golfer can visualize this projected beam and judge the position and motion of the golf club, and particularly the head of the club, during the golf swing. It differs from prior art because the laser or light beam is not projected in the direction that the club face travels and the ball is desired to travel, but is rather nominally normal to the direction of travel of the club face. It also differs from prior art in that the device is attachable and detachable from the club. As the golfer swings the club, the beam 30 and optional second beam 32 project upon the ground or upon a screen, providing visual feedback to the golfer. The screen, if necessary; can be a mat that is placed on the ground at the feet of the golfer. In a preferred embodiment, the mat is relatively reflective at the laser wavelength, and enhances the visibility of the spot from the beam. Lines, targets, or patterns may be imprinted upon the screen in order to assist in the monitoring of the golf swing. In another preferred embodiment, the golfer wears special filter eyeglasses that selectively transmit the wavelength of the laser, which can be near 635 nm, and attenuates the ambient light, thereby enhancing the visibility of the red laser beam with respect to ambient light. The invention can be used without special glasses, but in certain outdoor bright sunlight conditions, the projection of beam 30 on the ground or on a screen may be difficult for the golfer to see. The use of a 635 nm laser provides a more visible projected spot than does the use of a 670 nm laser of the same optical power. The spot size of the beam when it strikes the ground can be adjusted with the output collimating lens of laser 2, with the optimization being executed in order to achieve the most visible spot on the ground or a screen. When available for a reasonable price, lasers of wavelengths other than red wavelengths can also be used. For example, green would be very useful, as green is highly visible to the human eye.

The concept can be extended to the use of invisible (infrared, for example) lasers and the use of a detecting device or devices placed on the ground near the golfer. In this embodiment, the beam 30 or 32 can pass over the detector, which can incorporate a silicon photodiode and suitable electronics. In this case, the feedback that is provided to the golfer is dependent upon the detector or detectors' response to the beam 30 or 32. For example, as the beam 30 passes over the detector or detectors, the detector or detectors can be configured to provide an audible signal. A certain audible sound may indicate that the swing path was "good" or "bad". This type of configuration can be used by blind golfers, for example.

Not shown in FIG. 4 is a simple adhesive tape that can be taped to shaft 14. This tape can depict gradation lines, which help the golfer reference angle 46 upon attaching the device, and help the golfer adjust angle 46. Double-sided adhesive tape, as is commonly available, can be used between clamp 36 and shaft 14 to assist in the clamping of device 34 to shaft 14. This double-sided tape can help prevent slippage of the device 34 with respect to the shaft 14 when the device is used for actual golf shots. The shock of striking the ball can result in torque on device 34, which can result in change of angle 46, unless some double-sided tape is used to prevent relative motion. Another technique for preventing rotation is to ensure that the clamps 36 and 38 can be adjusted to provide enough pressure to prevent slippage.

An important aspect of the invention is the attachability and detachability of the device to and from golf clubs. In this way, the users can try many different clubs with the same laser training device. In a preferred embodiment, the clamp 36 is a two-piece clamp in order to facilitate attachment and detachment from the shaft of the golf club. It is designed to allow attachment to most golf club shafts in the vicinity of the head of the club. Knobs 40 and 42 are tightened to lock the position of the device 34 onto the club, effectively fixing angles 44 and 46. With the help of a coach, a golfer can adjust angles 44 and 46 to project the beam 30 onto the ground or a screen in a way that provides visual feedback about the position of the head of the club. The coach can verify that the golf swing looks good, and the golfer can monitor the path of the laser beam on the ground. The projection of beam 30 onto the ground or a screen is particularly useful in gaging the position of the head of the club during the end of the backswing, the beginning of the downswing, and the transition between the two. In a preferred embodiment, the device 34 is rugged enough for the golfer to strike real golf balls. This is based upon the ruggedness and shock resistant nature of the solid state laser diode source.

While a visible laser diode or diodes are used in the preferred embodiment, it may be possible to utilize non-laser light sources as well. However, the brightness of the laser diode source is beneficial in the projection of a bright spot on the ground or a screen.

This technique can be extended to other sports as well. For example, a similar device can be attached to a tennis racket in order to monitor the tennis serve. When the racket is behind the head, it is difficult for the player to see the racket or gage its position. With this visible laser aiming device, the projection of a beam like beam 30 can be used to gage the position of of the tennis swing.

Changes and modifications in the specifically described embodiments can be carried out without departing from the scope of the invention which is intended to be limited only by the scope of the appended claims.

What is claimed is:

1. A golf swing training device for use with a golf club by a golfer, comprising:

a golf club including a head coupled to a shaft;

at least one laser device coupled to the golf club producing at least one laser beam;

a power source coupled to the laser device; and an attachment mechanism securing the laser device to said shaft of the golf club;

such that said laser beam provides a feedback signal to the golfer indicative of a position and a motion of the head during the tap of a backswing of the golf club by the golfer.

2. The swing training device of claim 1, where said laser device generates a visible laser beam and a visible projected beam, and said feedback is a visual feedback to the golfer.

3. The swing training device of claim 1, wherein the feedback signal is also indicative of a position and a motion of the head during a beginning of a downswing, and a transition between the backswing and the downswing.

4. The swing training device of claim 3, wherein the feedback signal is a visualization by the golfer of a projection of said laser beam tracing a path on the ground.

5. The swing training device of claim 1, wherein the attachment mechanism provides a coupled and a detachment of the laser device to and from said golf.

6. The swing training device of claim 1, wherein the laser beam is projected at an angle that is non-parallel to the shaft of said golf club.

7. The swing training device of claim 1, wherein said laser beam is projected on the ground.

* * * * *